US012644649B2

(12) United States Patent
Suto et al.

(10) Patent No.: US 12,644,649 B2
(45) Date of Patent: Jun. 2, 2026

(54) VENTILATION STRUCTURE

(71) Applicant: Nature Architects Inc., Tokyo (JP)

(72) Inventors: Kai Suto, Tokyo (JP); Kotaro Tanimichi, Tokyo (JP)

(73) Assignee: Nature Architects Inc., Tokyo (JP)

( * ) Notice: Subject to any disclaimer, the term of this patent is extended or adjusted under 35 U.S.C. 154(b) by 316 days.

(21) Appl. No.: 18/282,969

(22) PCT Filed: Mar. 24, 2022

(86) PCT No.: PCT/JP2022/013877
§ 371 (c)(1),
(2) Date: Sep. 19, 2023

(87) PCT Pub. No.: WO2022/202977
PCT Pub. Date: Sep. 29, 2022

(65) Prior Publication Data

US 2024/0167768 A1 May 23, 2024

(30) Foreign Application Priority Data

Mar. 24, 2021 (JP) ..... 2021-050869

(51) Int. Cl.
*F28D 1/03* (2006.01)

(52) U.S. Cl.
CPC ..... *F28D 1/0366* (2013.01)

(58) Field of Classification Search
CPC ..... F28D 1/0366; F28D 9/0025; F28D 9/0068
See application file for complete search history.

(56) References Cited

U.S. PATENT DOCUMENTS 10,704,841 B2 7/2020 Manzo
11,389,765 B2 * 7/2022 Roy ..... B33Y 80/00
(Continued)

FOREIGN PATENT DOCUMENTS

JP 05-280883 A 10/1993
JP 08-110182 A 4/1996
JP 2019155279 A 9/2019

OTHER PUBLICATIONS

Al-ketan, Oraib & Abu Al-Rub, Rashid. (2020). MSLattice: A free software for generating uniform and graded lattices based on triply periodic minimal surfaces. Material Design & Processing Communications, 2021, 3:e205, doi: 10.1002/mdp2.205. 10pp.
(Continued)

*Primary Examiner* — Jon T. Schermerhorn, Jr.
(74) *Attorney, Agent, or Firm* — The Roy Gross Law Firm, LLC; Roy D. Gross

(57) ABSTRACT

An embodiment of the present disclosure provides a structure (100) including a partition wall structure (110) formed based on a periodic surface forming a first channel space (120) and a second channel space (130) in a state where the first channel space (120) and the second channel space (130) are separated from each other, the first channel space (120) being formed of multiple first channels (122) connected to each other, the second channel space (130) being formed of multiple second channels (132) connected to each other. A region where a ratio of a channel diameter of the first channels (122) and a channel diameter of the second channels (132) changes is provided in at least a part of the structure (100).

11 Claims, 8 Drawing Sheets

(56) References Cited

U.S. PATENT DOCUMENTS

| | | | | |
|---|---|---|---|---|
| 2019/0033013 | A1 | 1/2019 | Byfield | |
| 2020/0215480 | A1 * | 7/2020 | Roy | B01D 71/022 |

OTHER PUBLICATIONS

European Patent Office, Extended European Search Report for European Patent Application No. 22775758.0, dated Feb. 12, 2025, 9pp.
PCT International Search Report for International Application No. PCT/JP2022/013877, mailed May 10, 2022, 6pp.
PCT Written Opinion for International Application No. PCT/JP2022/013877, mailed May 10, 2022, 3pp.

* cited by examiner

VENTILATION STRUCTURE

CROSS REFERENCE TO RELATED APPLICATIONS

This application is a National Phase of PCT Patent Application No. PCT/JP2022/013877 having International filing date of Mar. 24, 2022, which claims the benefit of priority of Japanese Patent Application No. 2021-050869, filed Mar. 24, 2021, the contents of which are all incorporated herein by reference in their entirety.

TECHNICAL FIELD

The present disclosure relates to a structure, and more specifically relates to a structure that is applicable to uses such as heat exchange and ventilation.

BACKGROUND ART

PTL 1 discloses a gas-liquid separation apparatus including two channels separated by a gyroid periodic minimal surface. In addition, PTL 2 discloses a heat exchanger including two channels separated by various periodic minimal surfaces. In PTLS 1 and 2, the specific surface area is increased by using the periodic minimal surface as the partition wall separating the two channels in order to achieve improvement in gas-liquid separation efficiency and heat exchange efficiency.

In addition, PTL 3 discloses a heat exchanger formed of a triply periodic minimal surface in which the size of the unit cell hierarchically changes.

CITATION LIST

Patent Literature

PTL 1
Japanese Patent Application Laid-Open No. 2019-155279
PTL 2
U.S. patent Ser. No. 10/704,841 (Specification)
PTL 3
US Patent Application Publication No. 2020/0215480 (Specification)

SUMMARY OF INVENTION

Technical Problem

In the structures disclosed in PTLS 1 and 2, the two channels separated by the periodic minimal surface have equal shapes and sizes, and the two channels are homogeneous in the entirety of the structure. As such, a distribution of gas-liquid separation characteristics and heat exchange characteristics cannot be provided in the structure while homogeneous gas-liquid separation characteristics and heat exchange characteristics can be obtained in the entirety of the structure.

In addition, the structure disclosed in PTL 3 is formed of a triply periodic minimal surface in which the size of the unit cell hierarchically changes, and the diameter of one channel and the diameter of the other channel separated by the triply periodic minimal surface in each unit differ depending on the unit size; however, the ratio thereof is constant regardless of the size of the unit. As such, also in the structure disclosed in PTL 3, the heat exchange characteristics are homogeneous in the entirety of the structure, and a distribution of the heat exchange characteristics cannot be provided in the structure.

Further, PTLS 1 to 3 disclose a gas-liquid separation apparatus and a heat exchanger used in various industrial plants and the like, but do not disclose or suggest an idea of using the structure using the periodic minimal surface disclosed therein for windows, walls and the like for the purpose of heat exchange, ventilation and the like. As such, the structures disclosed in PTLS 1 to 3 do not take into account how the inflow path and the outflow path for the outside air and inside air are formed in the case where they are applied to windows, walls and the like for the purpose of heat exchange and ventilation, how the opening for lighting is configured, and the like.

Solution to Problem

A structure of the present disclosure includes a partition wall structure formed based on a periodic surface forming a first channel space and a second channel space in a state where the first channel space and the second channel space are separated from each other, the first channel space being formed of multiple first channels connected to each other, the second channel space being formed of multiple second channels connected to each other. A region where a ratio of a channel diameter of the first channels and a channel diameter of the second channels changes is provided in at least a part of the structure.

Other features and advantages of the present disclosure can be understood from the following description and accompanying drawings, which are given in an illustrative and non-exhaustive manner.

BRIEF DESCRIPTION OF DRAWINGS

FIGS. 9A and 9B are conceptual views for describing a change in volume ratio between a first channel space and a second channel space in the structure illustrated in FIGS. 1 and 2, FIG. 9A is a diagram illustrating a cross section of the structure where the first and second channels extending along the x-axis direction in the drawing appear, and unit volume units each extracted from the structure at each position along the y-axis direction in the drawing, and FIG. 9B is a graph illustrating a relationship of a volume ratio between the first channel space and the second channel space in the unit volume unit at each position;

DESCRIPTION OF EMBODIMENTS

An embodiment of the present disclosure is described below with reference to the accompanying drawings.

Figure 1:
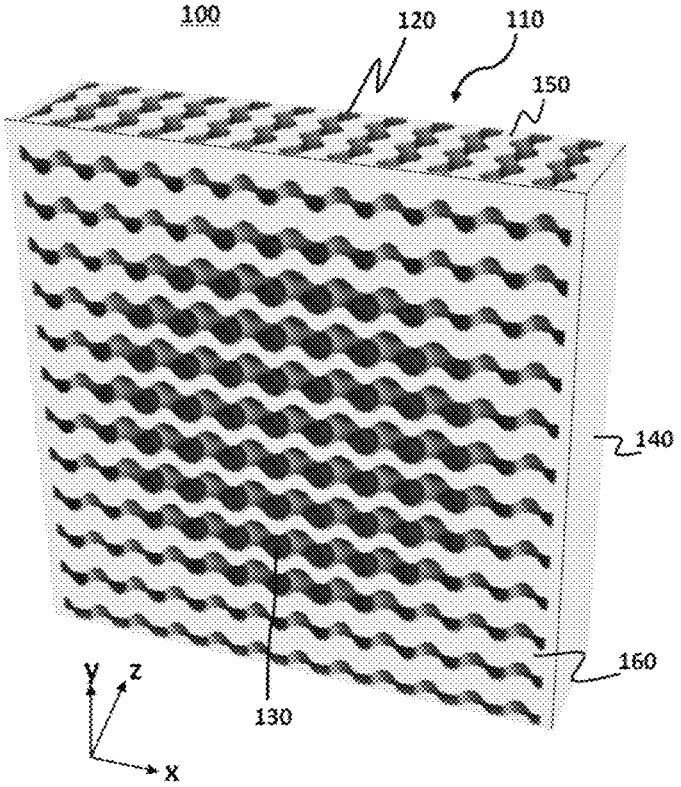
FIG. 1 is a perspective view illustrating a structure according to an embodiment of the present disclosure.

First, a general configuration of a structure 100 according to an embodiment of the present disclosure is described. FIG. 1 is a perspective view illustrating the structure according to the embodiment of the present disclosure, and FIG. 2 is a front view of the structure illustrated in FIG. 1.

Figure 2:
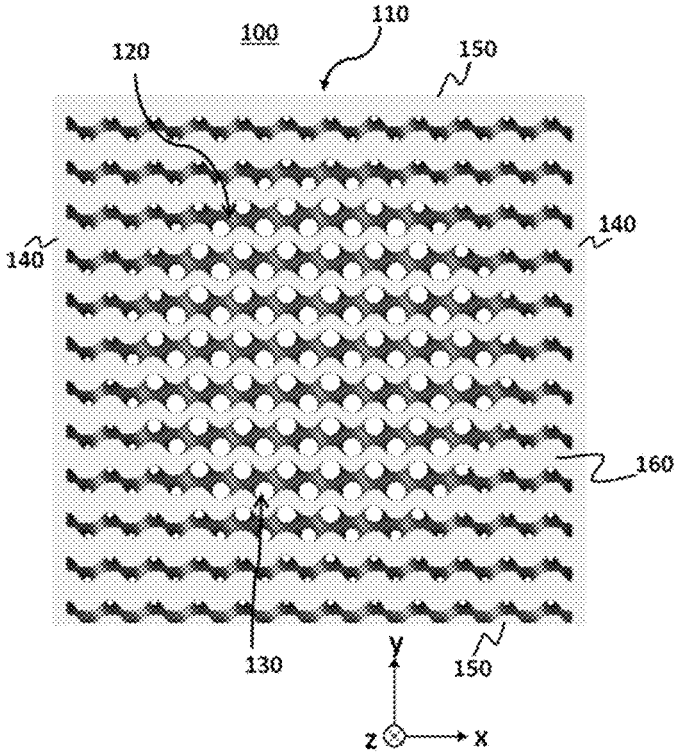
FIG. 2 is a front view of the structure illustrated in FIG. 1.

As illustrated in FIGS. 1 and 2, the structure 100 of the present embodiment includes a partition wall structure 110 that forms two channel spaces 120 and 130 separated from each other, and the structure 100 is formed in a cuboid shape, for example. In the description of the present embodiment, a coordinate system is defined with the lateral direction, vertical direction and depth direction of the structure 100 set as the x axis, y axis and z axis as illustrated in FIGS. 1 and 2.

The partition wall structure 110 of the structure 100 of the present embodiment forms a first channel space 120 that carries first fluid in the y-axis direction in the drawing, and a second channel space 130 that carries second fluid in the z-axis direction in the drawing.

The two channel spaces 120 and 130 are separated from each other by the partition wall structure 110, and the first and second fluids flowing through the two channel spaces 120 and 130 do not mix with each other.

The structure 100 of the present embodiment includes a first sealing part 140 that seals open end surfaces of the partition wall structure 110 in both sides parallel to the yz-plane in the drawing on the left and right sides in the drawing. The first sealing part 140 has a wall shape that covers the entirety of each open end surface of the partition wall structure 110 on the left and right sides in the drawing. The first and second channel spaces 120 and 130 are open to the outside space of the partition wall structure 110 at the open end surfaces of the partition wall structure 110, but with the first sealing part 140 covering the entire surface of the open end surfaces of the partition wall structure 110, the first and second channel spaces 120 and 130 are terminated in a state where they are separated from each other by the partition wall structure 110. In this manner, each fluid flowing through the first and second channel spaces 120 and 130 does not flow out to the outside from the open end surfaces of the partition wall structure 110 on the left and right sides in the drawing.

In addition, the structure 100 of the present embodiment includes a second sealing part 150 that seals a part of open end surfaces of the partition wall structure 110 in both sides parallel to the xz-plane on the upper and lower sides in the drawing. The second sealing part 150 is formed to seal only the second channel space 130 that carries the second fluid in the z-axis direction in the drawing in the open end surfaces of the partition wall structure 110 on the upper and lower sides in the drawing. In this manner, at the both surfaces of the structure 100 on the upper and lower sides in the drawing, the first channel space 120 that carries the first fluid in the y-axis direction in the drawing is connected to the outside space, while the second channel space 130 that carries the second fluid is terminated.

Further, the structure 100 of the present embodiment includes a third sealing part 160 that seals a part of open end surfaces of the partition wall structure 110 in both sides parallel to the xy-plane in the drawing on the front and rear sides in the drawing. The third sealing part 160 is formed to seal only the first channel space 120 that carries the first fluid in the open end surfaces of the partition wall structure 110 on the front and rear sides in the drawing. In this manner, at the both surfaces of the structure 100 on the front and rear sides in the drawing, the second channel space 130 that carries the second fluid in the z-axis direction in the drawing is connected to the outside space, while the first channel space 120 that carries the first fluid is terminated.

According to the structure 100 of the present embodiment having the above-described configuration, the first fluid that has flowed into the first channel space 120 from one surface side of the upper and lower sides along the y-axis direction in the drawing flows through the first channel space 120 to flow out of the first channel space 120 from the other surface side of the upper and lower sides in the drawing. On the other hand, the second fluid that has flowed into the second channel space 130 from one surface side of the front and rear sides along the z-axis direction in the drawing flows through the second channel space 130 to flow out of the second channel space 130 from the other surface side of the front and rear sides in the drawing.

Next, the partition wall structure 110 in the structure 100 of the present embodiment is described. The partition wall structure 110 may be composed of a wall with a constant thickness formed based on a periodic surface. As the periodic surface, for example, a helical surface of a double helical screw forming two helical spaces adjacent to and separated from each other with one helical wall and the other helical wall, and a periodic minimal surface, especially a triply periodic minimal surface (hereinafter also referred to as "TPMS") may be used.

Here, a "minimal surface" is a surface that locally minimizes its area, and the surface has a zero mean curvature at all points. The zero mean curvature means that a mean curvature of the minimal surface is zero at all points on the surface. The mean curvature is an average of two principal curvatures, and the principal curvatures are the maximum value and the minimum value of a normal curvature at a specific point on the surface of the minimal surface. On the opposite side of each point on the surface of the minimal surface, there is a point having a curvature equal in absolute value and opposite in sign, and accordingly the mean curvature is zero in the entire surface.

In addition, the "triply periodic minimal surface (TPMS)" is a triple cyclic minimal surface with a surface periodically repeated in three different directions. The triply periodic minimal surface divides a space into two volumes separated from each other. The two volumes separated from each other may form two spaces intricately intertwined with each other, but the two spaces are not connected to each other. The triply periodic minimal surface includes, for example, a Gyroid surface, a Schwarz P surface, a Schwarz D surface, a Fischer-Koch S surface, and a Lidinoid surface, but the triply periodic minimal surface applicable in the present embodiment is not limited to these surfaces. In addition, in the present embodiment, it is possible to adopt a periodic minimal surface structure formed by arbitrarily combining two or more triply periodic minimal surfaces described above.

In the example described in the present embodiment, the partition wall structure 110 is formed based on a gyroid, which is an example of the TPMS. A gyroid minimal surface is represented by the following function F (x, y, z).

$$F(x,y,z)=\sin(x)\cos(y)+\sin(y)\cos(z)+\sin(z)\cos(x) \quad \text{(Equation 1)}$$

Subsequently, the first and second channel spaces 120 and 130 formed inside the partition wall structure 110 are described in more detail.

Figure 3:
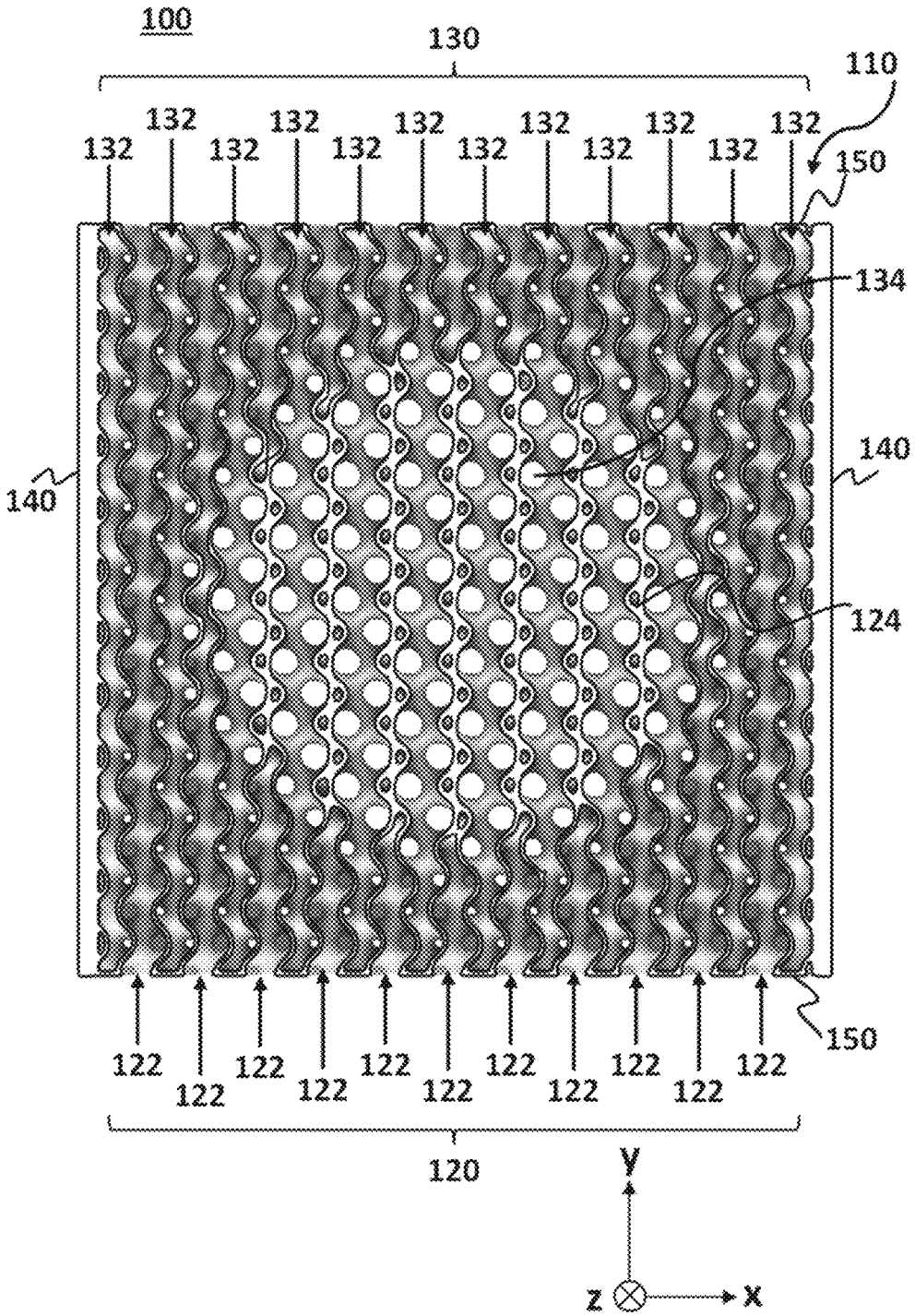
FIG. 3 is a cross-sectional diagram illustrating the structure illustrated in FIGS. 1 and 2 taken along a plane parallel to the xy-plane in the drawing.
Figure 4:
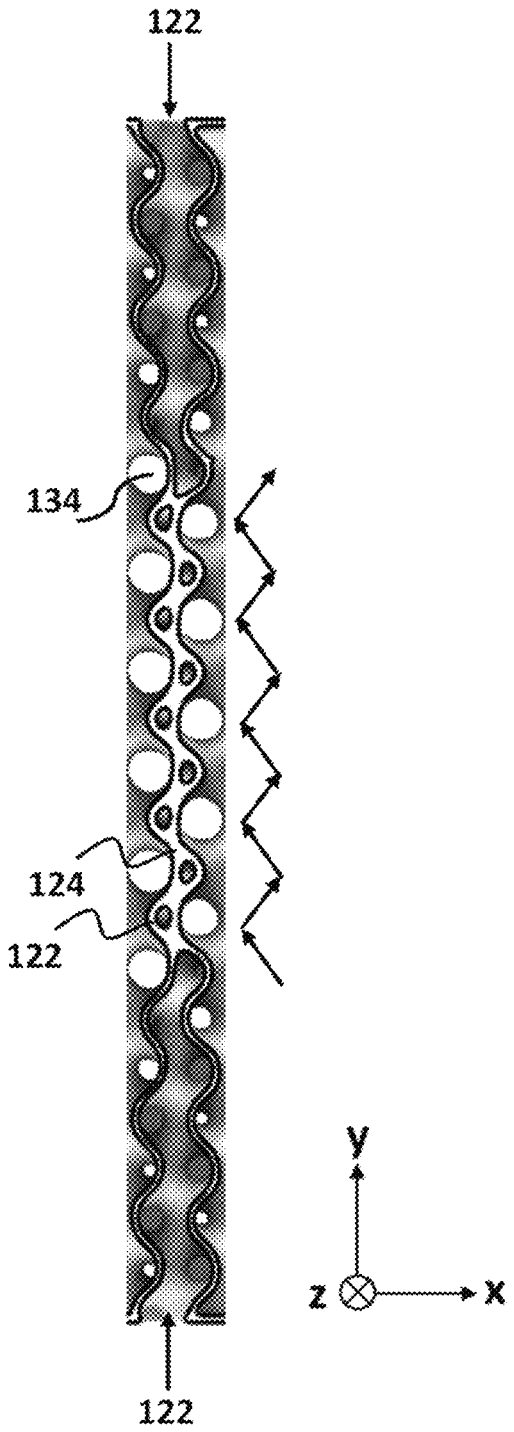
FIG. 4 is an enlarged diagram illustrating one first channel illustrated in FIG. 3.
Figure 5:
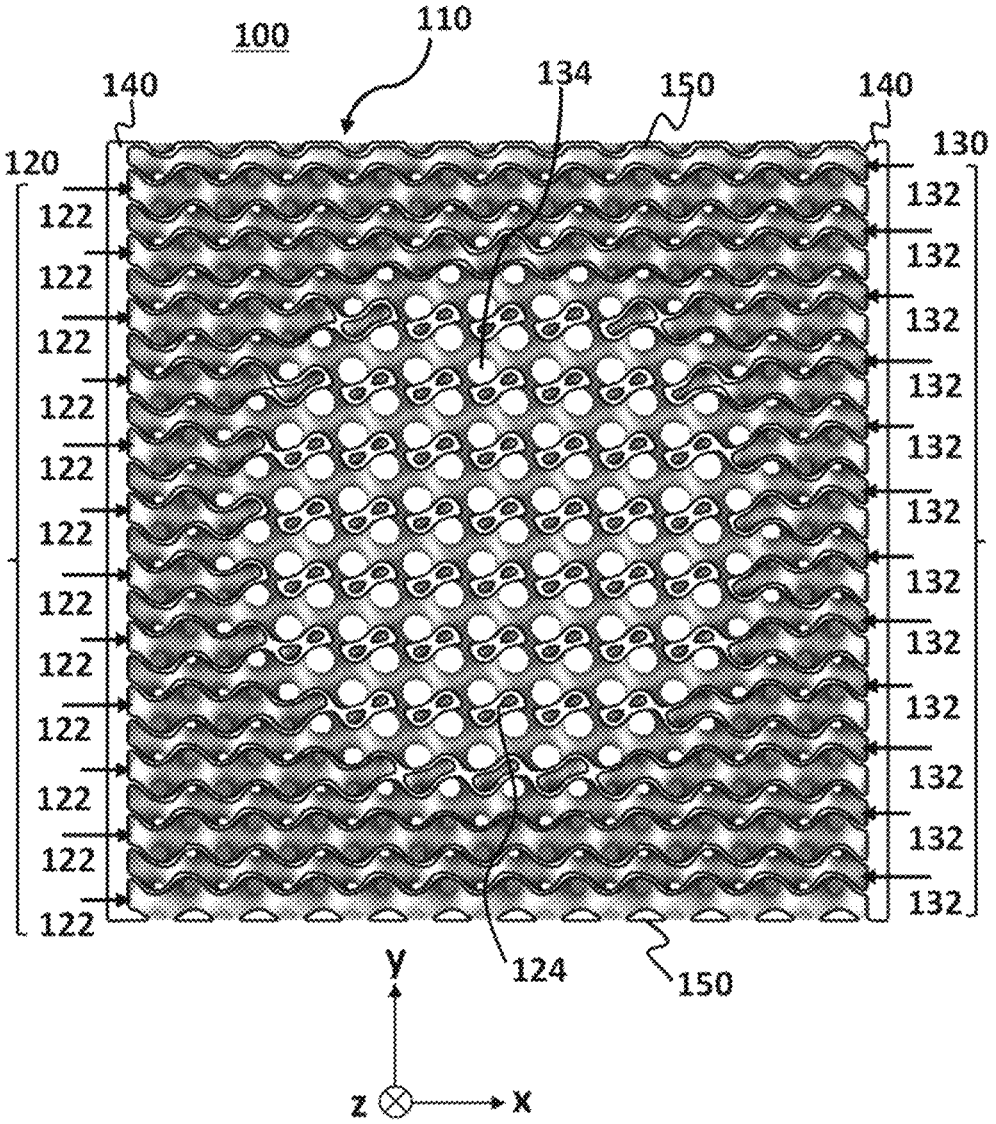
FIG. 5 is a cross-sectional diagram illustrating the structure illustrated in FIGS. 1 and 2 taken along a plane parallel to the xy-plane at a position shifted in the z-axis direction in the drawing by a half period of the periodic surface with respect to the cross section illustrated in FIG. 3.

FIG. 3 is a cross-sectional diagram illustrating the structure illustrated in FIGS. 1 and 2 taken along a plane parallel to the xy-plane in the drawing. FIG. 4 is an enlarged diagram illustrating one first channel illustrated in FIG. 3. FIG. 5 is a cross-sectional diagram illustrating the structure illustrated in FIGS. 1 and 2 taken along a plane parallel to the xy-plane at a position shifted in the z-axis direction in the drawing by a half period of the periodic surface with respect to the cross section illustrated in FIG. 3.

With reference to FIG. 3, in the cross section illustrated in FIG. 3, multiple first channels 122 extending in the y-axis direction, which is the up-down direction in the drawing, are formed at an interval in the partition wall structure 110 of the structure 100 of the present embodiment. Each first channel 122 has a sine wave shape in the extending direction in its cross-section. The first channels 122 are open to the outside space of the structure 100 at the bottom surface and top surface of the structure 100 in the drawing. As described later, these first channels 122 are formed to be connected to each other, and the first channels 122 integrally form the first channel space 120 that carries the first fluid in the y-axis direction in the drawing.

Note that in the cross section illustrated in FIG. 3, the channel of some first channels 122 in a region at or near the center of the partition wall structure 110 appears to be disconnected, but in fact the channel is continuous with no disconnection and is connected between the bottom surface and top surface of the structure 100 in the drawing as with the other first channels 122. Each first channel 122 has a sine wave shape in the extending direction in its cross section, and has a shape extending in a helically swirling manner in its entirety. Portions 124, of the first channel 122, where the channel appears to be disconnected has in fact a shape helically extending around the y-axis direction in the drawing, and cross sections of the channel appear because the diameter of the portions 124 is smaller than that of the other portions. In the cross section illustrated in FIG. 3, longitudinal cross sections of the portions 124 with the relatively smaller diameter along the y-axis direction in the drawing are illustrated, and cross sections of each first channel 122 passing through the corresponding portion 124 are shown to be scattered.

The flow of fluid in the first channel 122 with such a helical shaped portions 124 is described below with reference to FIG. 4. For example, the fluid having flowed into an extending portion of the first channel 122 extending in the y-axis direction in the drawing from the lower side in FIG. 4 flows inside the extending portion of the first channel 122 to the upper side in the y-axis direction in the drawing. Then, the fluid flows into the portions 124 with the smaller diameter to flow to the upper side in the y-axis direction in the drawing in the first channel 122 in the portions 124 while swirling around the y axis in the drawing as schematically illustrated with the arrow in FIG. 4. Then, the fluid flows to the upper side in the y-axis direction in the drawing in the extending portion on the upper side in the drawing in the first channel 122, and flows out of the first channel 122.

With reference to FIG. 3 again, multiple second channels 132 extending in the y-axis direction, which is the up-down direction in the drawing, are formed at an interval in the partition wall structure 110. The multiple first channels 122 and the multiple second channels 132 are disposed next to each other in a staggered manner in the x-axis direction in the drawing. Each second channel 132 also has a sine wave shape in the extending direction in its cross section, and has a shape extending in a helically swirling manner in its entirety. At the bottom surface and top surface of the structure 100 in the drawing, the second channels 132 are sealed and terminated with the second sealing part 150 and are not open to the outside space of the structure 100. As described later, the second channels 132 are also formed to be connected to each other, and the second channels 132 integrally form the second channel space 130 that carries the second fluid in the z-axis direction in the drawing.

When the structure 100 is viewed from the front side (or the side opposite to the front side) as illustrated in FIG. 3, the opposite side of the structure 100 can be seen in a see-through manner through openings 134 of each second channel 132 extending in the z-axis direction in the drawing.

Next, with reference to FIG. 5, in the cross section illustrated in FIG. 5, the multiple first channels 122 are formed at an interval so as to extend in the x-axis direction, which is the left-right direction in the drawing, in the partition wall structure 110 of the structure 100 of the present embodiment. The first channel 122 has a sine wave shape helically extending in the extending direction in its cross-section. Each of the multiple first channels 122 extending in the x-axis direction in the drawing is connected to each of the multiple first channels 122 extending in the y-axis direction, which is the up-down direction in the drawing in the cross section illustrated in FIG. 3. In the partition wall structure 110, the multiple first channels 122 extending in the up-down direction in the drawing (y-axis direction) as illustrated in the cross section illustrated in FIG. 3 and the multiple first channels 122 extending in the left-right direction in the drawing (x-axis direction) as illustrated in the cross section illustrated in FIG. 5 are formed such that both of them alternately appear in the front-rear direction in the drawing (z-axis direction). Thus, these first channels 122 form a three-dimensional grid in the partition wall structure 110. These multiple first channels 122 integrally form the first channel space 120 with a complex and intricate labyrinth shape.

Likewise, in the cross section illustrated in FIG. 5, the multiple second channels 132 are formed at an interval so as to extend in the x-axis direction, which is the left-right direction in the drawing, in the partition wall structure 110 of the structure 100 of the present embodiment. Each second channel 132 has a sine wave shape helically extending in the extending direction in its cross-section. Also in the x-axis direction in the drawing, the multiple first channels 122 and the multiple second channels 132 are disposed next to each other in a staggered manner. Regarding the second channels 132, as with the first channels 122, each of the multiple second channels 132 extending in the x-axis direction in the drawing is connected to each of the multiple second channels 132 extending in the y-axis direction, which is the up-down direction in the drawing in the cross section illustrated in FIG. 3, and, in the partition wall structure 110, the multiple second channels 132 extending in the up-down direction in the drawing (y-axis direction) as illustrated in the cross section illustrated in FIG. 3 and the multiple second channels 132 extending in the left-right direction in the drawing (x-axis direction) as illustrated in the cross section illustrated in FIG. 5 are formed to alternately appear in the front-rear direction in the drawing (z-axis direction) such that the second channels 132 form a three-dimensional grid in the partition wall structure 110. These multiple second channels 132 integrally form the second channel space 130 with a complex and intricate labyrinth shape.

Note that as described above, the open end surfaces of the partition wall structure 110 on the left and right sides in the drawing are sealed with the first sealing part 140, and the first and second channel spaces 120 and 130 that are open to the outside space of the partition wall structure 110 at the open end surfaces of the partition wall structure 110 are terminated by the first sealing part 140 in the state where they are separated from each other by the partition wall structure 110.

Figure 6A:
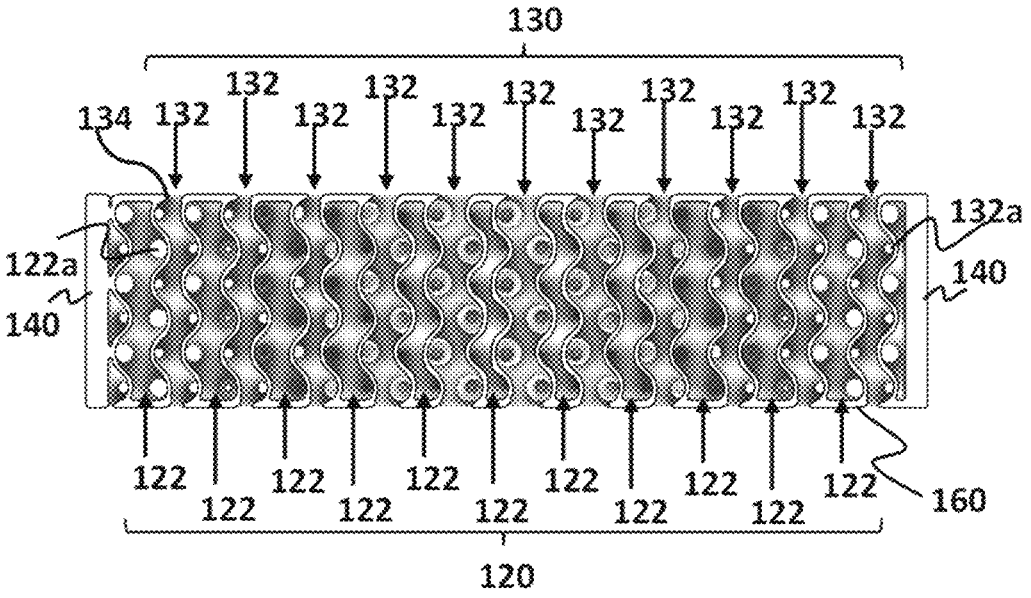
FIG. 6A is a cross-sectional diagram illustrating the structure illustrated in FIGS. 1 and 2 taken along a plane parallel to the xz-plane in the drawing.
Figure 6B:
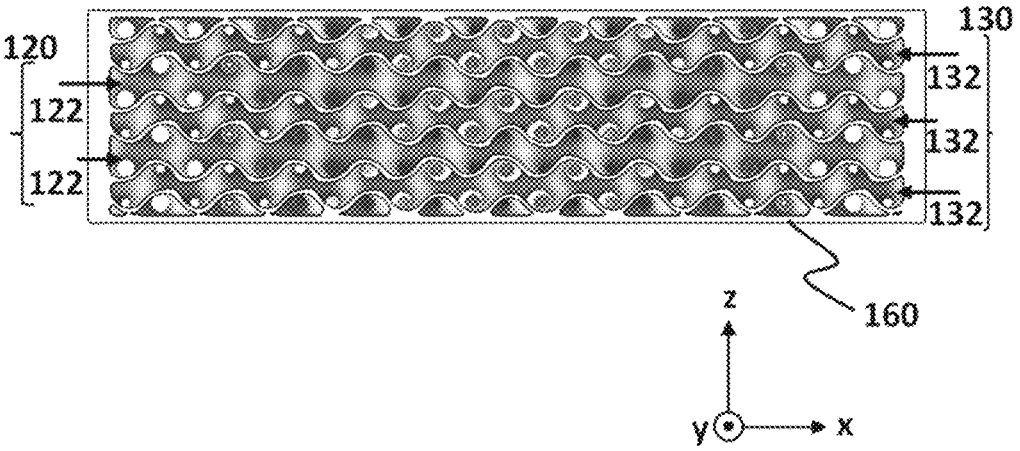
FIG. 6B is a cross-sectional diagram illustrating the structure illustrated in FIGS. 1 and 2 taken along a plane parallel to the xz-plane in the drawing at a position shifted in the y direction in the drawing by a half period of the periodic surface with respect to the cross section illustrated in FIG. 6A.

FIG. 6A is a cross-sectional diagram illustrating the structure illustrated in FIGS. 1 and 2 taken along a plane parallel to the xz-plane in the drawing. FIG. 6B is a cross-sectional diagram illustrating the structure illustrated in FIGS. 1 and 2 taken along a plane parallel to the xz-plane in the drawing at a position shifted in the y direction in the drawing by a half period of the periodic surface with respect to the cross section illustrated in FIG. 6A.

In the cross section illustrated in FIG. 6A, in the partition wall structure 110, the multiple first channels 122 are formed at an interval so as to helically extend in a sine wave shape in the z-axis direction, which is the up-down direction in the drawing, and the multiple second channels 132 are also formed at an interval so as to helically extend in a sine wave shape in the z-axis direction, which is the up-down direction in the drawing. In the cross section illustrated in FIG. 6A, the multiple first channels 122 and the multiple second channels 132 are disposed next to each other in a staggered manner in the x-axis direction in the drawing. Note that the end portions of each first channel 122 in the z-axis direction in the drawing are sealed with the third sealing part 160.

On the other hand, in the cross section illustrated in FIG. 6B, in the partition wall structure 110, the multiple first channels 122 are formed at an interval so as to helically extend in a sine wave shape in the x-axis direction, which is the left-right direction in the drawing, and the multiple second channels 132 are also formed at an interval so as to helically extend in a sine wave shape in the x-axis direction, which is the left-right direction in the drawing. In the cross section illustrated in FIG. 6B, the multiple first channels 122 and the multiple second channels 132 are disposed next to each other in a staggered manner in the x-axis direction in the drawing.

Now, the first channels 122 are described with reference to FIGS. 6A and 6B. For the sake of description, the leftmost first channel 122 in FIG. 6A is taken as an example of the first channels 122. A plurality of communication paths 122*a* connected to another adjacent first channel 122 is formed in the first channel 122. Although only one reference numeral 122*a* is indicated for the sake of clarity in FIG. 6A, a plurality of similar communication paths 122*a* is formed in each first channel 122. As an example, a communication path 122*a*, indicated with reference numeral 122*a*, extending from the leftmost first channel 122 extending in the z-axis direction in FIG. 6A is connected to the uppermost first channel 122 of FIG. 6B among the first channels 122 extending in the x-axis direction in the drawing and formed at a position shifted by the half period of the periodic surface in the y-axis direction in the drawing. The adjacent first channels 122 extending in different directions are connected to each other through the communication paths 122*a* formed in the above-described manner. It is thus understood that pluralities of first channels 122 extending in the respective x, y, and z axis directions are connected to each other through these communication paths 122*a*, and integrated to form the first channel space 120 with a complex and intricate labyrinth shape.

As with the first channels 122, the second channels 132 are connected to each other through communication paths 132*a*. For the sake of description, the rightmost second channel 132 in FIG. 6A is taken as an example of the second channels 132. A plurality of communication paths 132*a* connected to another adjacent second channel 132 is also formed in the second channel 132. Although only one reference numeral 132*a* is indicated for the sake of clarity in FIG. 6A, a plurality of similar communication paths 132*a* is formed in each second channel 132. As an example, a communication path 132*a*, indicated with reference numeral 132*a*, extending from the rightmost second channel 132 extending in the z-axis direction in the drawing in FIG. 6A is connected to the uppermost second channel 132 in FIG. 6B among the second channels 132 extending in the x-axis direction in the drawing and formed at a position shifted by the half period of the periodic surface in the y-axis direction in the drawing. The adjacent second channels 132 extending in different directions are connected to each other through the communication paths 132*a* formed in the above-described manner. It is thus understood that pluralities of second channels 132 extending in the respective x, y and z-axis directions are also connected to each other through these communication paths 132*a*, and integrated to form the second channel space 130 with a complex and intricate labyrinth shape.

Figure 7A:
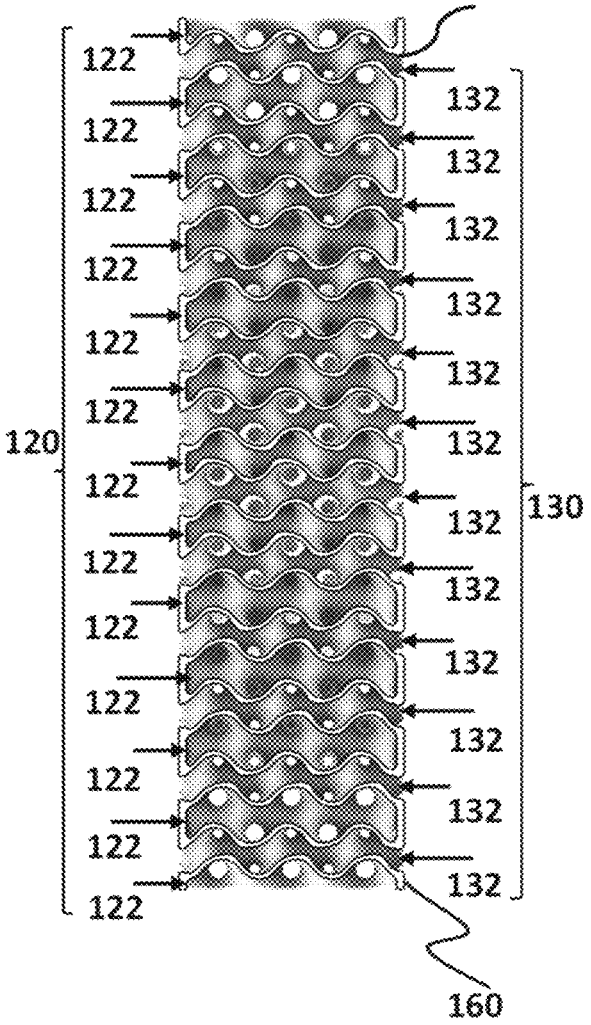
FIG. 7A is a cross-sectional diagram illustrating the structure illustrated in FIGS. 1 and 2 taken along a plane parallel to the yz-plane in the drawing.
Figure 7B:
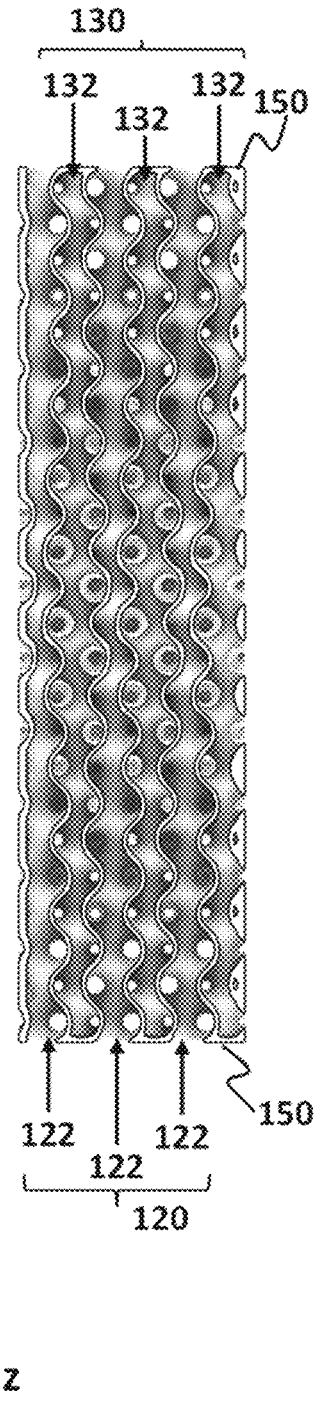
FIG. 7B is a cross-sectional diagram illustrating the structure illustrated in FIGS. 1 and 2 taken along a plane parallel to the yz-plane in the drawing at a position shifted in the x direction in the drawing by a half period of the periodic surface with respect to the cross section illustrated in FIG. 7A.

FIG. 7A is a cross-sectional diagram illustrating the structure illustrated in FIGS. 1 and 2 taken along a plane parallel to the yz-plane in the drawing. FIG. 7B is a cross-sectional diagram illustrating the structure illustrated in FIGS. 1 and 2 taken along a plane parallel to the yz-plane in the drawing at a position shifted in the x direction in the drawing by a half period of the periodic surface with respect to the cross section illustrated in FIG. 7A.

In the cross section illustrated in FIG. 7A, in the partition wall structure 110, the multiple first channels 122 are formed at an interval so as to helically extend in a sine wave shape in the z-axis direction, which is the left-right direction in the drawing, and the multiple second channels 132 are also formed at an interval so as to helically extend in a sine wave shape in the z-axis direction, which is the left-right direction in the drawing. In the cross section illustrated in FIG. 7A, the multiple first channels 122 and the multiple second channels 132 are disposed next to each other in a staggered manner in the y-axis direction in the drawing. The end portions of each first channel 122 in the z-axis direction in the drawing are sealed with the third sealing part 160.

On the other hand, in the cross section illustrated in FIG. 7B, in the partition wall structure 110, the multiple first channels 122 are formed at an interval so as to helically extend in a sine wave shape in the y-axis direction, which is the up-down direction in the drawing, and the multiple second channels 132 are also formed at an interval so as to helically extend in a sine wave shape in the y-axis direction, which is the up-down direction in the drawing. In the cross section illustrated in FIG. 7B, the multiple first channels 122 and the multiple second channels 132 are disposed next to each other in a staggered manner in the z-axis direction in the drawing.

The multiple first channels 122 illustrated in FIGS. 7A and 7B are also connected to each other through the communication paths 122*a* (the reference numeral is omitted in FIGS. 7A and 7B) to form the first channel space 120 with a labyrinth shape, and likewise, the multiple second channels 132 are connected to each other through the communication paths 132*a* (the reference numeral is omitted in FIGS. 7A and 7B) to form the second channel space 130 with a labyrinth shape.

As is clear from the above description, in the structure 100 of the present embodiment, the multiple first channels 122 and the multiple second channels 132 each extend in the three different directions (the x, y and z-axis directions), and the multiple first channels 122 and the multiple second channels 132 are disposed to be alternately adjacent to each other in each direction of the three different directions (each of the x, y and z-axis directions).

According to the structure 100 of the present embodiment with the above-described configuration, the open end surfaces of the partition wall structure 110 on the left and right sides in the drawing (in the x-axis direction) are sealed with the first sealing part 140, and further the openings of the multiple first channels 122 are sealed with the third sealing part 160 at the end surfaces of the partition wall structure 110 on the front and rear sides in the drawing (in the z-axis direction), thus terminating both of the opposite ends of the first channels 122 extending in the x-axis direction in the drawing and the opposite ends of the first channels 122 extending in the z-axis direction in the drawing. Therefore, the first fluid does not flow out of the structure 100 from the first channels 122 extending in these directions. As a result, the first fluid having flowed into the structure 100 from the bottom surface side of the structure 100 in the drawing passes through the first channel space 120 formed of the multiple first channels 122, and flows out of the structure 100 from the top surface side of the structure 100 in the drawing, for example. That is, the structure 100 of the present embodiment is configured such that the first fluid flows in the up-down direction in the drawing (y-axis direction) inside the first channel space 120.

The multiple first channels 122 forming the first channel space 120 are connected to each other so as to form a three-dimensional grid structure in the three directions of the x, y and z-axis directions inside the structure 100. Thus, the first fluid having flowed into a certain first channel 122 extending in the y-axis direction in the drawing from the bottom surface side of the structure 100 in the drawing may flow as it is through that first channel 122 to the upper side in the y-axis direction in the drawing, or may pass through the first channel 122 extending in an intersecting manner in the x-axis direction or the z-axis direction so as to enter another first channel 122 extending in the y-axis direction in the drawing and flow further to the upper side in the y-axis direction in the drawing, for example. Regardless of the paths of the first channels 122, the first fluid eventually flows out of the structure 100 from the top surface side of the structure 100 in the drawing.

In addition, according to the structure 100 of the present embodiment, the open end surfaces of the partition wall structure 110 on the left and right sides in the drawing (in the x-axis direction) are sealed with the first sealing part 140, and further the openings of the multiple second channels 132 are sealed with the second sealing part 150 at the end surfaces of the partition wall structure 110 on the upper and lower sides in the drawing (in the y-axis direction), thus terminating both of the opposite ends of the second channels 132 extending in the x-axis direction in the drawing and the opposite ends of the second channels 132 extending in the y-axis direction in the drawing. Therefore, the second fluid does not flow out of the structure 100 from the second channels 132 extending in these directions. As a result, the second fluid having flowed into the structure 100 from the near side of the structure 100 in the drawing passes through the second channel space 130 formed of the multiple second channels 132, and flows out of the structure 100 from the far side of the structure 100 in the drawing, for example. That is, the structure 100 of the present embodiment is configured such that the second fluid flows in the front-rear direction in the drawing (z-axis direction) inside the second channel space 130.

The multiple second channels 132 forming the second channel space 130 are defined by the outer peripheral surfaces of the multiple first channels 122 extending in the three directions forming the first channel space 130, and connected to each other so as to form a three-dimensional grid structure in the three directions of the x, y and z-axis directions in the drawing inside the structure 100. Thus, the second fluid having flowed into a certain second channel 132 extending in the z-axis direction in the drawing from the near side of the structure 100 in the drawing may pass through that second channel 132 as it is and flow to the far side in the z-axis direction in the drawing, or may hit the outer peripheral surface of a certain first channel 122 and change its flow direction so as to pass through the second channel 132 extending in the x-axis direction or the y-axis direction and flow into another second channel 132 extending in the z-axis direction in the drawing, then flowing further to the far side in the z-axis direction in the drawing, for example. Regardless of the paths of the second channels 132, the second fluid eventually flows out of the structure 100 from the far side of the structure 100 in the drawing.

Next, a configuration as a feature in the structure 100 of the present embodiment is described.

Figure 8:
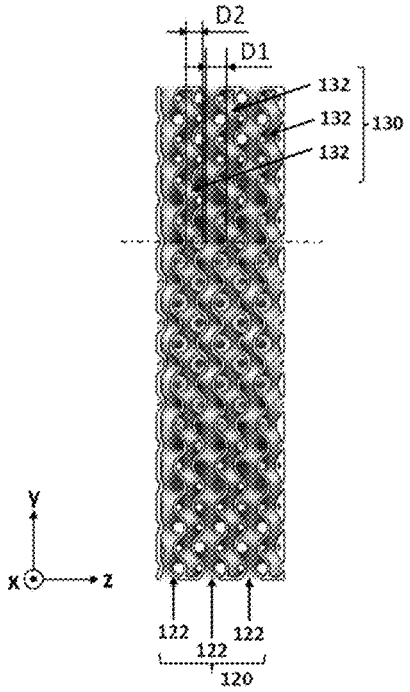
FIG. 8 is a diagram for describing a channel diameter ratio of a first channel and a second channel adjacent to each other with a partition wall structure therebetween in the cross-sectional diagram of the structure illustrated in FIG. 7B.

FIG. 8 is a diagram for describing a channel diameter ratio of the first channel and the second channel adjacent to each other with the partition wall structure therebetween in the cross-sectional diagram of the structure illustrated in FIG. 7B.

As illustrated in FIG. 8, the first and second channels 122 and 132 adjacent to each other with the partition wall structure 110 therebetween, which appear in the cross section of the structure 100 illustrated in FIG. 7B as an example, extend along the y-axis direction in the drawing as the first direction, and have channel diameters (or "channel widths"; the same shall apply hereinafter) D1 and D2, respectively, in the cross section (e.g., the cross section along the long dashed short dashed line in FIG. 8) along the xz-plane orthogonal to the y-axis direction in the drawing. A ratio D1/D2 of these channel diameters changes along the y-axis direction in the drawing as the first direction at least in a part of the structure 100.

Figure 9B:
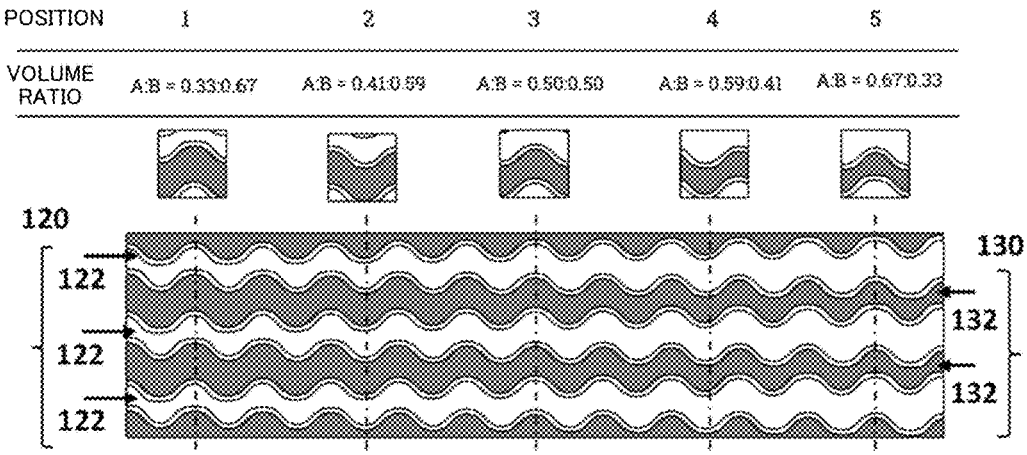
Figure 9B:
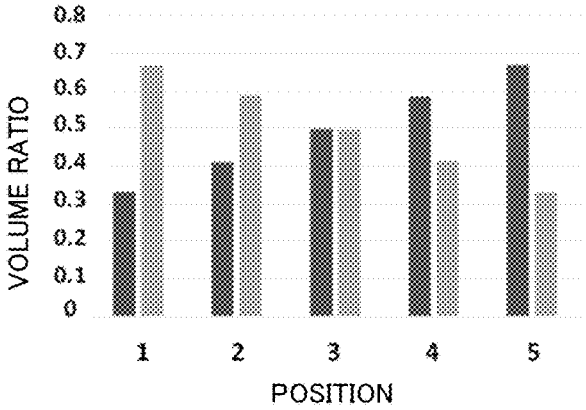

FIGS. 9A and 9B are conceptual views for describing a change in volume ratio between a first channel space and a second channel space in the structure illustrated in FIGS. 1 and 2. FIG. 9A is a diagram illustrating a cross section of the structure where the first and second channels extending along the x-axis direction in the drawing appear, and unit volume units each extracted from the structure at each position along the y-axis direction in the drawing, and FIG. 9B is a graph illustrating a relationship of a volume ratio between the first channel space and the second channel space in the unit volume unit at each position.

In the structure of the conceptual view illustrated in FIG. 9A, the ratio of the volume of the first channel space 120 formed of the multiple first channels 122 connected to each other and the volume of the second channel space 130 formed of the multiple second channels 132 connected to each other continuously changes along the y-axis direction in the drawing.

In FIG. 9A, the "A" of the volume ratio represents the volume ratio of the first channel space 120 formed of the multiple first channels 122 connected to each other, and the "B" of the volume ratio represents the volume ratio of the second channel space 130 formed of the multiple second channels 132 connected to each other. In the example of the conceptual view illustrated in FIG. 9A, the volume ratio A:B of the first channel space 120 and the second channel space 130 is 0.33:0.67 at the unit volume unit located at the position 1 in the y-axis direction in the drawing in the structure. The volume ratio A:B is 0.41:0.59 at the unit volume unit located at the position 2, the volume ratio A:B is 0.50:0.50 at the unit volume unit located at the position 3, the volume ratio A:B is 0.59:0.41 at the unit volume unit located at the position 4, and the volume ratio A:B is 0.67:0.33 at the unit volume unit located at the position 5.

In FIG. 9A, the values of the volume ratio at the positions 1 to 5 along the y-axis direction are discrete as an example, but the above-described volume ratio may continuously change along the y-axis direction in the drawing. This can be understood especially from FIG. 9B in which the volume ratio of the first channel space 120 illustrated in thick grey gradually increases from the position 1 to the position 5, while the volume ratio of the second channel space 130 illustrated in light grey gradually decreases from the position 1 to the position 5.

It is thus understood that in the structure 100 of the present embodiment, it is provided a region where the ratio of the channel diameters of the first channels 122 and the second channels 132 extending in a certain direction adjacent to each other with the partition wall structure 110 therebetween changes along that direction, so that the volume ratio of the volume of the first channel space 120 of the first channels 122 connected to each other and the volume of the second channel space 130 of the second channels 132 connected to each other changes along the same direction in that region.

Figure 10:
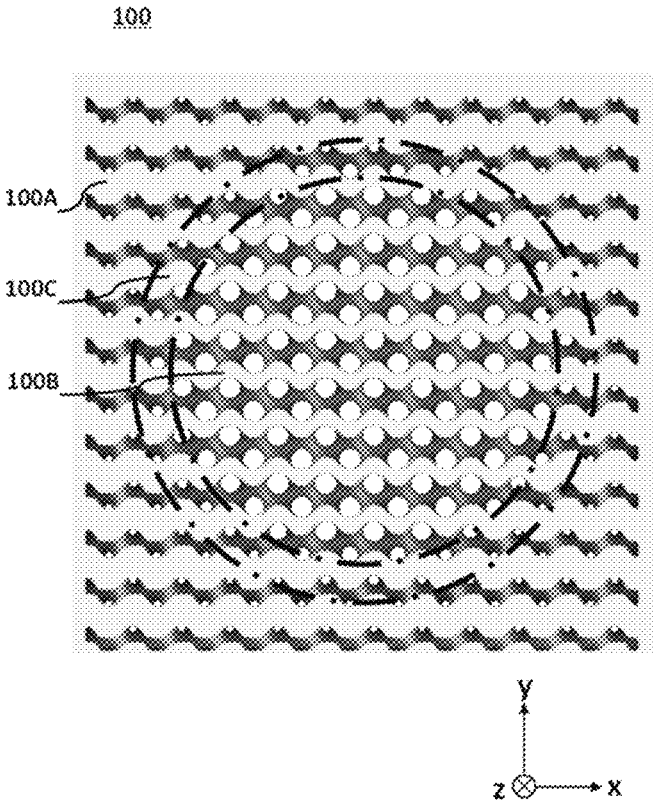
FIG. 10 is a diagram illustrating the front view of the structure illustrated in FIG. 2 with a long dashed short dashed line for description.

FIG. 10 is a diagram illustrating the front view of the structure illustrated in FIG. 2 with a long dashed short dashed line for description. As illustrated in FIG. 10, the structure 100 of the present embodiment includes a first space region 100A, a second space region 100B, and a third space region 100C.

In the example of the present embodiment, the first space region 100A is provided in a region around the structure 100. A region outside the outer long dashed short dashed line circle of the two long dashed short dashed line circles illustrated in FIG. 10 corresponds to the first space region 100A. The first space region 100A is a three-dimensional space formed of the region outside the outer long dashed short dashed line circle in FIG. 10 extending in the z-axis direction in the drawing.

In the first space region 100A, the channel diameter of the first channels 122 and the channel diameter of the second channels 132 are equal to each other, and when this is set as a first ratio represented by "the channel diameter of the first channels 122/the channel diameter of the second channels 132", its value is 1.

In the example of the present embodiment, the second space region 100B is provided on the center side of the structure 100, and has a circular shape when the structure 100 is viewed in the front-rear direction (the z-axis direction in the drawing) from the front surface as illustrated in FIG. 10. A region surrounded by the inner long dashed short dashed line circle of the two long dashed short dashed line circles illustrated in FIG. 10 corresponds to the second space region 100B. The second space region 100B is a three-dimensional space formed of the region surrounded by the inner long dashed short dashed line of FIG. 10 extending in the z-axis direction in the drawing.

In the second space region 100B, the first channels 122 have a channel diameter smaller than the diameter of the first channels 122 in the first space region 100A, while the second channels 132 have a channel diameter greater than the channel diameter of the second channels 132 in the first space region 100A. When the ratio represented by "the channel diameter of the first channels 122/the channel diameter of the second channels 132" in the second space region 100B is set as a "second ratio", its value is smaller than 1, and the relationship "first ratio>second ratio" holds.

Further, in the example of the present embodiment, the third space region 100C is provided between the first space region 100A and the second space region 100B. An annular region sandwiched between the two long dashed short dashed line circles illustrated in FIG. 10 corresponds to the third space region 100C. The third space region 100C is a three-dimensional space formed of the annular region sandwiched between the two long dashed short dashed line circles of FIG. 10 extending in the z-axis direction in the drawing.

In the third space region 100C, the first channels 122 and the second channels 132 are formed to have respective diameters that gradually decrease or gradually increase in a continuous manner such that the ratio of the channel diameters of the first channels 122 and the second channels 132 continuously changes from the first diameter ratio on the first space region 100A side to the second diameter ratio on the second space region 100B side. In this manner, the third space region 100C functions as a transition region that connects the two space regions that differ in the ratio of the channel diameters of the first channels 122 and the second channels 132 such that the channel diameters of the first channels 122 and the second channels 132 are continuously transitioned. Here, "the channel diameters of the first channels 122 and the second channels 132 are continuously transitioned" means that the first channels 122 and the second channels 132 are formed of smooth curved surfaces with no corner and/or step formed at connections to the first channels 122 and the second channels 132 in the first or second space region 100A or 100B adjacent to the third space region 100C, and with no corner and/or step formed also at the first channels 122 and the second channels 132 in the third space region 100C. Note that such a portion in the third space region 100C of the partition wall structure 110 can be formed by modifying the original periodic minimal surface such that the ratio of the channel diameters of the two channels separated by the periodic minimal surface gradually changes.

In this manner, the structure 100 of the present embodiment includes the first and second space regions 100A and 100B that differ in the ratio of the channel diameters. In the first space region 100A, the diameter of the first channel 122 and the diameter of the second channel 132 are the same. On the other hand, in the second space region 100B, the diameter of the first channel 122 is smaller than the diameter of the first channel 122 in the first space region 100A, and the diameter of the second channel 132 is larger than the diameter of the second channel 132 in the first space region 100A. Thus, the flow rate of the first fluid flowing through the first channels 122 of the second space region 100B is smaller than the flow rate of the first fluid flowing through the first channels 122 of the first space region 100A, and the flow rate of the second fluid flowing through the second channels 132 of the second space region 100B is greater than the flow rate of the first fluid flowing through the second channels 132 of the first space region 100A. As a result, in the second space region 100B, the volume per unit time of the second fluid flowing through the second channels 132 is greater than the volume per unit time of the first fluid flowing through the first channels 122, and thus more heat energy of the second fluid is supplied compared to the first fluid. Thus, in the second space region 100B, the first fluid flowing through the first channels 122 is more cooled or heated by the second fluid flowing through the second channels 132 than in the first space region 100A, and the heat exchange between the fluids is facilitated. That is, through the provision of the space regions where the diameter ratio of the first channels 122 and the second channels 132 differs, the structure 100 of the present embodiment can provide a distribution with different heat exchange efficiencies between the first fluid and the second fluid flowing through the first channels 122 and the second channels 132, respectively.

In addition, in the structure 100 of the present embodiment, when one first channel 122 and one second channel 132 adjacent to each other are set as a pair among the first and second channels 122 and 132 each extending in all of the x, y and z-axis directions, the channel width occupied by the pair of the channels 122 and 132 is constant regardless of the channel diameter ratio of the first and second channels 122 and 132. That is, the channel width occupied by the pair of the channels 122 and 132 adjacent to each other is constant in the first space region 100A whose channel diameter ratio is the first ratio, and in the second space region 100B whose channel diameter ratio is the second ratio, and further in the third space region 100C whose channel diameter ratio changes. In other words, the first channel 122 extending along a certain direction and the second channel 132 extending along that direction and located adjacent to the first channel 122 with the partition wall structure 110 therebetween are formed such that the sum of the channel diameter of the first channel 122 and the channel diameter of the second channel 132 is constant along that direction. This is shown in each drawing illustrating the cross section of each channel. It should be noted that the above-described configuration is merely an example, and the channel width occupied by the pair of the channels 122 and 132 adjacent to each other in the structure 100 of the present embodiment may not necessarily be constant.

Further, when the periodic surface forming the partition wall structure 110 is seen in a unit basis, the partition wall structure 110 may be formed such that the size of the unit changes stepwise in part or in its entirety. In this case, it may be formed such that the ratio of the channel diameters of the first and second channels 122 and 132 changes as described above in addition to the stepwise change of the size of the unit.

Next, examples of the application of the structure 100 of the present embodiment are described.

The structure 100 of the present embodiment may be used as an element component of a heat exchanger, for example. When there is a temperature difference between the first fluid flowing through the first channel space 120 in the up-down (y-axis) direction in the drawing and the second fluid flowing through the second channel space 130 in the front-rear (z-axis) direction in the drawing, heat of one fluid is transmitted to the other fluid through the wall of the partition wall structure 110 separating the channel spaces 120 and 130. As a result, for example, when liquid (such as water or oil such as ether oil and ester oil) having been cooled to a temperature lower than normal temperature is supplied as the first fluid to the first channel space 120, and air with normal temperature is supplied to the second channel space 130, the air passing through the second channel space 130 is cooled by the liquid flowing through the first channel space 120, and ejected from the structure 100 as cold air. In this case, the structure 100 functions as a part of a cooler or a cooling machine. Alternatively, when liquid having been heated to a temperature higher than normal temperature is supplied as the first fluid to the first channel space 120, and air with normal temperature is supplied to the second channel space 130, the air passing through the second channel space 130 is heated by the liquid flowing through the first channel space 120, and ejected from the structure 100 as hot air. In this case, the structure 100 functions as a part of a heater or a heating machine. Note that the above-described type and temperature of the fluid used as the first and second fluid are arbitrary, and are not limited to the above-described examples.

In particular, in the structure 100, the channel diameter of the second channels 132 is larger than the channel diameter of the first channels 122 in the second space region 100B, and thus the air with a larger flow rate can flow through the second channels 132 in the second space region 100B than in the other space regions. Thus, in the case where the structure 100 is used as a cooling machine or a heating machine as described above, for example, a larger air volume can be provided at or near the center in the second space region 100B.

On the other hand, the channel diameter of the first channels 122 is smaller than the channel diameter of the second channels 132 in the second space region 100B, and the flow rate of the air flowing through the first channels 122 is smaller than in the other space regions in the second space region 100B. When it is assumed that the flow rate per unit cross-sectional area is the same for the first and second channels 122 and 132 in the second space region 100B, the volume of each fluid flowing through the respective channels 122 and 132 per unit time differs depending on the ratio of the channel diameters of the respective channels 122 and 132. Further, the energy of the heat carried or absorbed by each fluid is proportional to the volume of each fluid. Thus, while the first fluid passes through the first channels 122 of the second space region 100B, the high or low temperature heat energy stored in the first fluid is more absorbed by the second fluid flowing through the second channels 132 of the same second space region 100B. That is, in the second space region 100B of the structure 100, more heat energy of the first fluid flowing through the first channels 122 with a relatively small channel diameter can be transmitted to the second fluid flowing through the second channels 132 with a relatively large channel diameter. As a result, the first fluid passing through the first channels 122 of the second space region 100B flows out of the first channel 122 in a state where it has been cooled or heated by the second fluid flowing through the second channels 132 than when it passes through the first channels 122 of other space regions. In other words, in the second space region 100B, the heat energy stored in the second fluid flowing through the second channels 132 can be more reliably transmitted to the first fluid flowing through the first channels 122.

Further, in the structure 100 of the present embodiment, the channel diameter of the second channels 132 is larger than the channel diameter of the first channels 122 in the second space region 100B, and as such the second channels 132 in the second space region 100B have a larger opening and extends through to the opposite side of the structure 100 when the structure 100 is viewed from the front side as illustrated in FIG. 2 in particular. Thus, the state of the opposite side of the structure 100 can be seen in a see-through manner through the openings 134 (see FIG. 3 and the like) of the second channels 132 in the second space region 100B. Alternatively, light can be taken from the opposite side of the structure 100 through the second channels 132 in the second space region 100B. Furthermore, it is also possible to transmit sound through the second channels 132 in the second space region 100B.

In particular, when the state of the opposite side of the structure 100 is viewed in a see-through manner through the openings 134 of the second channels 132 in the second space region 100B, the visibility of the state of the opposite side of the structure 100 differs depending on whether the structure 100 is viewed from the front side or an oblique front side. When the structure 100 is viewed from the front side, the state of the opposite side is seen similarly to the circular shape of the second space region 100B as illustrated in FIG. 2, but when it is viewed from the oblique side, a part of light passing through the second channels 132 of the second space region 100B is blocked by the thickness of the structure 100 in the z-axis direction in the drawing (so-called "vignetting" phenomenon), and as a result, the position, size and shape of the region where the opposite side of the structure 100 can be visually recognized changes depending on the viewing angle.

To take advantage of the above-described features, the structure 100 of the present embodiment may be used as at least a part of a window frame and/or a wall of a house, for example. In this case, for example, by supplying the first channel space 120 with cooled or heated first fluid and supplying the second channel space 130 with air flowing in the direction from the outside to inside of the house, the outside air can be taken into the house in a state where the outside air has been cooled or heated by the structure 100.

Further, light such as sunlight can be directly taken from the outside of the house through the second channels 132 in the second space region 100B. When sunlight is taken, the time of the day for taking the light and the direction of the light can be set in accordance with the direction in which the structure 100 is installed. For example, the morning sun can be captured by installing the structure 100 such that the front surface (the xy-plane in the drawing) faces east, and sunlight can be captured throughout the longer hours of the day by installing the structure 100 such that the front surface faces south.

Furthermore, hearing external sounds from the inside of a house, or having a conversation between the inside and outside of a house can be achieved through the second channels 132 in the second space region 100B. This also makes it possible to talk directly through the structure 100 without opening the door or window when visitors are present in particular.

In addition, an example in which different fluids are supplied to the first channel space 120 and the second channel space 130 of the structure 100 is described above, the same fluid may be supplied. As an example, it is possible to supply air to the first channel space 120 in a direction of ejecting it from the inside to outside of a house, and supply air to the second channel space 130 in a direction of taking it from the outside to inside of the house. In this case, the structure 100 functions as an element component of a heat exchanging ventilation apparatus. For example, in the case where the outside air is cold and the air inside the house is hot, the outside air taken from the outside into the house through the second channel space 130 of the structure 100 is heated while it passes through the structure 100 by the air flowing through the first channel space 120 to be ejected from the inside of the house. On the other hand, the air flowing through the first channel space 120 to be ejected from the inside of the house is cooled by the outside air taken from the outside into the house through the second channel space 130. In the case where the temperature of the outside air and the temperature of the inside air have an inverse relationship to the above, the heating and cooling of air also have an inverse relationship to the above. In this manner, in the case where the structure 100 of the present embodiment is used as a heat exchanging ventilation apparatus, the ventilation can be performed while reusing the heat energy of the hot heat or cold heat stored in the indoor air ejected during the ventilation. As a result, the air energy consumed for the cooling and heating of the indoor can be reduced.

(Modifications)

Figure 11:
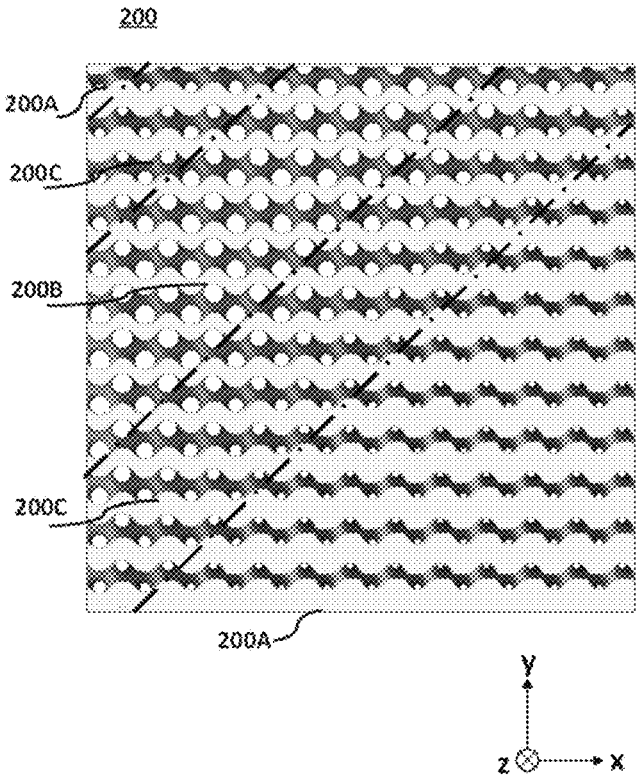
FIG. 11 is a front view illustrating a modification of the structure according to the embodiment of the present disclosure.

Next, modifications of the structure of the present embodiment are described. FIG. 11 is a front view illustrating a modification of the structure according to the embodiment of the present disclosure.

As illustrated in FIG. 11, a structure 200 according to the present modification includes a first space region 200A in most of the lower right region in the xy-plane on the front surface side in the drawing, and in a part of the left upper region in the xy-plane on the front surface side in the drawing. In addition, the structure 200 includes a second space region 200B with a shape obliquely extending from the left lower side toward the right upper side in the left upper region in the xy-plane on the front surface side in the drawing. Further, the structure 200 includes a third space region 200C in two regions between the first space region 200A and the second space region 200B.

The configurations of first and second channel spaces formed by a partition wall structure in the respective space regions 200A, 200B and 200C of the structure 200 of the present modification, and first and second channels forming these respective channel spaces are the same as those configurations in the above-described structure 100. In addition, the configurations of respective sealing parts of the structure 200 of the present modification are also the same as those configurations in the above-described structure 100.

In the structure 200 of the present modification, the second channels have a relatively large channel diameter in the second space region 200B with a shape obliquely extending from the left lower side toward the right upper side in the left upper region in the xy-plane in the drawing, and the various advantages described above with reference to the structure 100 can be used in that region.

Note that it is described above an example in which the above-described structures 100 and 200 include the two space regions that differ in the ratio of the channel diameters of the first channels and the second channels, and the space region transitioning the two regions, but the space regions that may be provided in the structure of the present embodiment are not limited to this.

For example, it is possible to adopt a configuration including three or more space regions that differ in the ratio of the channel diameters of the first channels and the second channels, and multiple space regions transitioning the three or more space regions. Alternatively, it is possible to adopt a configuration in which the ratio of the channel diameters of the first channels and the second channels changes in the entirety of the structure. In this case, it is possible to adopt a configuration in which the ratio of the channel diameters of the first channels and the second channels uniformly changes in the entirety of the structure, or a configuration in which the ratio of the channel diameters of the first channels and the second channels gradually decreases in a certain region of the structure, while gradually increasing in other regions.

In this manner, the ratio of the flow rates of the first and second fluids flowing in the first channels and the second channels, respectively, can be set at more multiple levels in the structure. In addition, it is possible to achieve more diverse designs based on the openings of the respective channels appearing at the surface of the structure.

As described above, with the structure according to the present embodiment, the space regions that differ in the ratio of the channel diameters of the first channels and the second channels can be disposed in various shapes and sizes as necessary in accordance with the use, function, design and the like of the structure.

In addition, while an example in which the structure of the present embodiment is applied to heat exchangers and/or ventilation apparatuses used in a house and the like is described above, the application of the structure of the present embodiment is not limited to this, and it is also applicable to various industrial heat exchangers, and heat exchangers used for aero engines, power plants and the like, for example.

The structure of the present embodiment may be formed by using a resin material, a metal material and the like in part or in its entirety by using additional manufacturing technology. Examples of the additional manufacturing technology include 3D printing technology and light shaping technology using photosetting resins. It should be noted that the additional manufacturing technology may not necessarily be used for the manufacture of the structure of the present embodiment, and in the case where the shape of the structure can be manufactured by other manufacturing technology (such as cutting, molding, injection molding, powder compression shaping, and laser processing), such manufacturing technology other than the additional manufacturing technology may be used for the manufacture.

Although the disclosure has been described above through the embodiments of the disclosure, the embodiments described above do not limit the claimed invention. Also, forms combining the features described in the embodiments of the disclosure may be included in the technical scope of the disclosure. Further, it is also clear to those skilled in the art that various modifications or improvements can be made to the embodiments described above.

The invention claimed is:

1. A structure comprising a partition wall structure formed based on a periodic surface forming a first channel space and a second channel space in a state where the first channel space and the second channel space are separated from each other, the first channel space being formed of multiple first channels connected to each other, the second channel space being formed of multiple second channels connected to each other, wherein a region where a ratio of a channel diameter of the first channels and a channel diameter of the second channels changes is provided in at least a part of the structure, each first channel and each second channel adjacent to the first channel with a partition wall structure therebetween extend along a first direction, and a ratio of a channel diameter of the first channels in a cross section along a plane orthogonal to the first direction and a channel diameter of the second channels in the cross section along the plane changes along the first direction.

2. The structure according to claim 1, wherein the first channel that extends along the first direction, and the second channel that is adjacent to the first channel with the partition wall structure therebetween and extends along the first direction are formed such that a sum of the channel diameter of the first channel and the channel diameter of the second channel is constant along the first direction.

3. The structure according to claim 1, wherein the first and second channels in the region are formed such that the ratio of the channel diameter of the first channels and the channel diameter of the second channels continuously changes from a first ratio to a second ratio different from the first ratio.

4. The structure according to claim 3, wherein the structure is provided with at least a first region where the ratio of the channel diameter of the first channels and the channel diameter of the second channels is the first ratio, a second region where the ratio of the channel diameter of the first channels and the channel diameter of the second channels is the second ratio, and a third region located between the first region and the second region, and wherein the first and second channels in the third region are formed such that the ratio of the channel diameter of the first channels and the channel diameter of the second channels continuously changes from the first ratio to the second ratio from one end portion connected to the first and second channels of the first region to the other end portion connected to the first and second channels of the second region.

5. The structure according to claim 4, wherein the structure has a cuboid shape, wherein the first channel space is formed such that the multiple first channels are open to outside of the structure at first opposite surfaces of the structure, wherein the second channel space is formed such that the multiple second channels are open to the outside of the structure at second opposite surfaces orthogonal to the first opposite surfaces of the structure, wherein the second region is formed in a circular shape when one of the second opposite surfaces of the structure is viewed from a front side, and wherein the second ratio in the second region is smaller than the first ratio in the first region.

6. The structure according to claim 1, wherein the periodic surface is formed based on a periodic minimal surface.

7. The structure according to claim 6, wherein the periodic minimal surface is a triply periodic minimal surface.

8. The structure according to claim 7, wherein the triply periodic minimal surface includes any one of a Gyroid surface, a Schwarz P surface, a Schwarz D surface, a Fischer-Koch S surface, and a Lidinoid surface.

9. The structure according to claim 7, wherein the multiple first channels and the multiple second channels each extend in three different directions, and wherein the multiple first channels and the multiple second channels are disposed such that the multiple first channels and the multiple second channels are alternately adjacent to each other in each of the three different directions.

10. A heat exchanger comprising the structure according to claim 1.

11. A ventilation apparatus comprising the structure according to claim 1.

* * * * *